US005407107A

United States Patent [19]

Smith

[11] Patent Number: 5,407,107

[45] Date of Patent: Apr. 18, 1995

[54] DISPENSER CLOSURE

[75] Inventor: Ernest L. Smith, Kansas City, Mo.

[73] Assignee: Sealright Co., Ltd., Kansas City, Mo.

[21] Appl. No.: 162,363

[22] Filed: Dec. 6, 1993

Related U.S. Application Data

[63] Continuation of Ser. No. 875,317, Apr. 29, 1992, abandoned.

[51] Int. Cl.[6] ..... B65D 47/20

[52] U.S. Cl. ..... 222/548; 222/565

[58] Field of Search ..... 222/548, 565, 541, 480

[56] References Cited

U.S. PATENT DOCUMENTS

| | | | |
|---|---|---|---|
| 954,206 | 4/1910 | Rau | 222/548 |
| 1,959,260 | 5/1934 | Angyal | 222/548 |
| 2,123,906 | 7/1938 | Masbach et al. | 222/541 |
| 2,281,620 | 5/1942 | Roeger | 222/548 |
| 2,562,647 | 7/1951 | Shaver | 222/548 |
| 2,764,453 | 9/1956 | Robb et al. | 222/548 |
| 2,961,132 | 11/1960 | Ankney | 222/548 |
| 2,977,029 | 3/1961 | Henchert | 222/548 |
| 3,101,877 | 8/1963 | Driscoll | 222/548 |
| 3,143,256 | 8/1964 | Lazure et al. | 222/541 |
| 3,149,755 | 9/1964 | Porter et al. | 222/548 |
| 3,261,516 | 7/1966 | Allen | 222/548 |
| 3,294,293 | 12/1966 | Johns | 222/548 |
| 3,333,744 | 8/1967 | Nilsen et al. | 222/565 |
| 3,388,841 | 6/1968 | McHardy et al. | 222/548 |
| 3,397,823 | 8/1968 | Kirkpatrick | 222/541 |
| 3,463,364 | 8/1969 | Rehag | 222/548 |
| 3,912,128 | 10/1975 | Ziemann et al. . | |
| 4,346,823 | 8/1982 | Eppenbach | 222/548 |
| 4,541,541 | 9/1985 | Hickman et al. . | |

FOREIGN PATENT DOCUMENTS

| | | | |
|---|---|---|---|
| 1816709 | 2/1970 | Germany | 222/548 |
| 4002 | of 1899 | United Kingdom | 222/548 |
| 251316 | 5/1926 | United Kingdom | 222/548 |
| 607139 | 8/1948 | United Kingdom | 222/565 |

*Primary Examiner*—Michael S. Huppert
*Assistant Examiner*—Thomas J. Brahan
*Attorney, Agent, or Firm*—Kokjer, Kircher, Bowman & Johnson

[57] ABSTRACT

A dispensing container for granular or powderous materials, The container body has a circular periphery and an upwardly facing opening with an upper edge which is preferably rolled as is known in the art. After the container has been filled with the appropriate contents a sealing disk is secured to the upper edge of the container side walls. The sealing disk includes several circumferentially spaced openings and has a periphery larger than that of the container body such that a peripheral edge extends outwardly and downwardly from the upper edge of the container walls. The openings in the sealing disk are initially covered with adhesive labels to maintain the contents within the container. A selector cap is then applied over the sealing disk simply by downward movement thereover. The selector cap includes a downwardly extending skirt having a detent portion which engages with the outwardly extending outer periphery of the sealing disk. This engagement maintains the selector cap upon the container but allows it to rotate about the longitudinal axis thereof. The selector cap is preferably formed of a somewhat resilient material such that the user may engage the skirt to remove the cap from the container. The labels covering the openings may then be removed and the selector cap replaced upon the container. The cap includes an opening therethrough which may be aligned with the openings in the sealing disk to allow dispensing of the contents from the container.

12 Claims, 1 Drawing Sheet

DISPENSER CLOSURE

This is a continuation of application Ser. No. 07/875,317, filed Apr. 29, 1992, now abandoned.

BACKGROUND OF THE INVENTION

1. Field of the Invention

The present invention relates in general to containers which allow the dispensing of material. In particular, the present invention relates to an improved closure for a container which allows the user to easily dispense powdered or granular material.

2. Description of the Related Art

For many years it has been found desirable to package certain materials, in particular food items such as spices, in containers which allow the user to easily dispense the material. One such arrangement is a standard spice container having a metal container body with a substantially rectangular periphery. The lid for such a container is formed as a monolithic plastic unit having one or more hinged lids which may be raised to an open position to provide access a large opening for a spoon, several small openings defining a shaker or other similar openings. While these containers function well, their cost is relatively high, due to the metal used to form the body and the processes required to form the body. Another factor increasing cost is the formation of the closure, which must be molded with the lids in the open position, with a later step to close the lids.

To reduce the costs of such items, it is preferred that they be formed of less expensive materials, and by less expensive processes. One such possibility is to form the container body having a substantially circular periphery. Where the periphery is substantially circular, the container may be provided with a dispensing lid as shown in U.S. Pat. Nos. 3,912,128 and 4,541,541. This closure shows a base closure which connects to the container body and includes a semi-circular punch-out which may be removed by the consumer. Rotatably mounted to this base is a cover plate which includes a first semi-circular opening substantially corresponding to the punch-out and a second circular opening of a much smaller size used for shaking. While this arrangement is serviceable, it necessitates forming two separate plastic moldings and an assembly step to pivotally connect the cover to the base member.

SUMMARY OF THE INVENTION

An object of the present invention is to provide a container which will allow the user to easily dispense material therefrom.

Another object of the present invention is to provide a closure which may be mounted upon a round periphery container.

Another object of the present invention is to provide such a closure which reliably seals the contents of the container prior to purchase by the consumer.

Yet another object of the present invention is to provide such a closure which will allow the user to select between a variety of opening sizes and types.

Yet a further object of the present invention is to provide such a closure which is easy to manufacture and assemble, thus reducing the cost of the closure.

These and other objects are achieved by a dispensing container for granular or powderous materials. The container body has a circular periphery and an upwardly facing opening with an upper edge which is preferably rolled as is known in the art. After the container has been filled with the appropriate contents a sealing disk is secured to the upper edge of the container side walls. The sealing disk includes several circumferentially spaced openings and has a periphery larger than that of the container body such that a peripheral edge extends outwardly and downwardly from the upper edge of the container walls. The openings in the sealing disk are initially covered with adhesive labels to maintain the contents within the container. A selector cap is then applied over the sealing disk simply by downward movement thereover. The selector cap includes a downwardly extending skirt having a detent portion which engages with the outwardly extending outer periphery of the sealing disk. This engagement maintains the selector cap upon the container but allows it to rotate about the longitudinal axis thereof. The selector cap is preferably formed of a somewhat resilient material such that the user may engage the skirt to remove the cap from the container. The labels covering the openings may then be removed and the selector cap replaced upon the container. The cap includes an opening therethrough which may be aligned with the openings in the sealing disk to allow dispensing of the contents from the container.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figure 1:
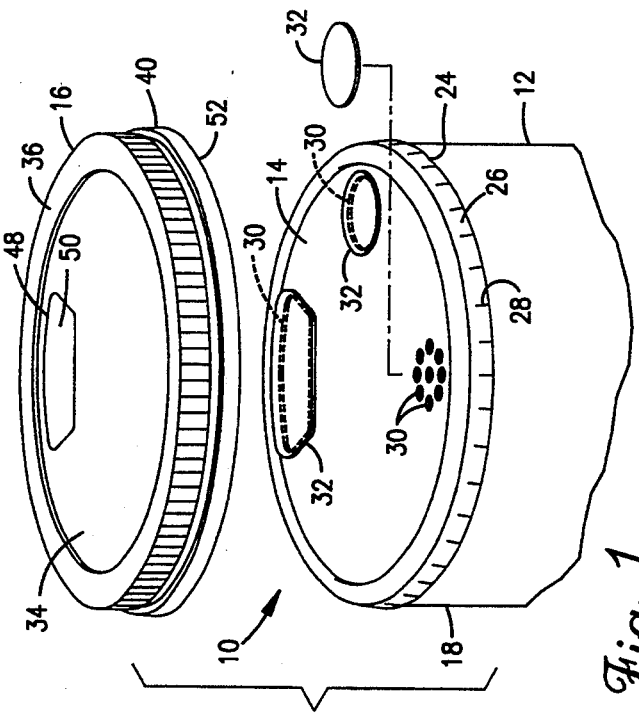
FIG. 1 is an exploded perspective view of a dispensing container according to the present invention.

With reference to FIG. 1, a container according to the present invention is generally designated by reference numeral 10. The container 10 generally consists of a container body 12, a sealing disk 14 and a selector cap 16.

Figure 4:
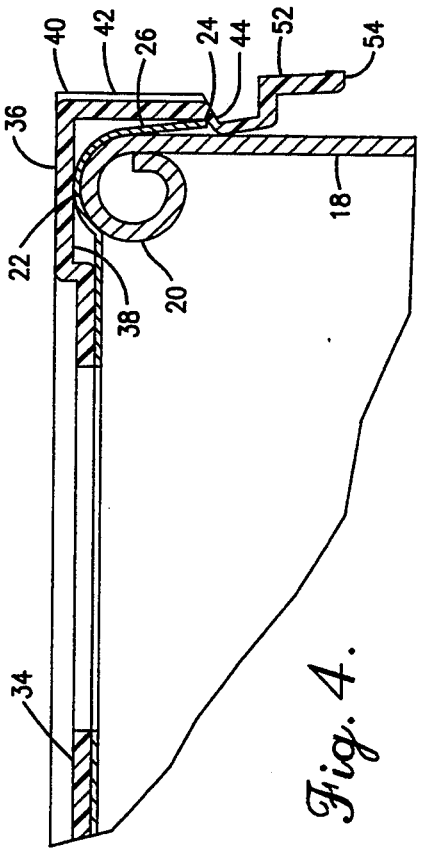
FIG. 4 is a partial cross-sectional view of an assembled container.

As is best shown with reference to FIGS. 1 and 4, the container body 12 is of a standard design having a bottom (not shown) with a substantially circular outer periphery and a side wall 18 extending upwardly from such periphery. The bottom and side wall together define an upwardly opening cavity to hold the contents of the container. The upper edges 20 of the side wall 18 define an opening for the cavity through which the contents of the container may be passed. The upper edges 20 are preferably rolled as is known in the art to define at least an upwardly facing arcuate portion 22. While it is preferred that the upper edges 20 are provided with a complete inward roll, this is not strictly necessary. The edges may include no roll at all, or only a partial roll to define the arcuate portion 22. Similarly, the roll direction may be peripherally inward as in FIG. 4, or outward.

The body 12 may be formed of diverse materials such as a metal bottom with paper board side walls, or may be formed of a single type of material and may even be formed as a monolithic plastic unit. The particular materials used to form the container 12 are not critical except in their ability to adhere to the sealing disk 14 as discussed more fully below.

After the contents of the container have been placed within the container body, the sealing disk is applied. The sealing disk 14 is preferably formed as a substantially circular member which is mounted to the upper edge 20 of the container body 12. The sealing disk 14 is preferably formed as a piece of sheet material punched to the proper circular form. This circular form will have an outer periphery 24 which is larger than that of the arcuate portion 22 (or at least the upper edge 20).

The sealing disk 14 is secured to the arcuate portion 22 at a position spaced inwardly from the outer periphery 24 of the disk 14. This seal preferably extends about the entirety of the arcuate portion 22 and may be effected in any manner consistent with the materials forming the disk and container side wall. For example, the side wall may be formed of paperboard while the sealing disk is formed as a laminate of an upper paper layer and a lower plastic layer. This plastic layer would thus abut against the arcuate portion 22 and be capable of being ultrasonic or heat sealed to the arcuate portion. Alternatively, the seal may be effected by adhesives, or other means known in the art.

As is best shown in FIG. 4, the seal between the disk 14 and arcuate portion 22 is spaced inwardly from the outer peripheral edge 24 of the disk. As such, an outer peripheral portion 26 of the disk may be bent downwardly over the upper edge 20 of the container. This downward bend is facilitated by the use of arcuate portion 22. Specifically, the seal between the disk 14 and arcuate portion 22 may extend to a .peripherally outer segment on the arcuate portion 22 where the tangent at such a point extends downwardly and outwardly with respect to the side walls. This will ensure that the outer peripheral portion 26 extends downwardly and outwardly of the container body, While this arrangement is preferred, it is not believed to be strictly necessary, as sealing disks formed of certain materials may be sealed to the upper edge 20 without an arcuate portion 22, bent downwardly thereover, and still sufficiently retain this downward bend to achieve the objects of the present invention.

Figure 3:
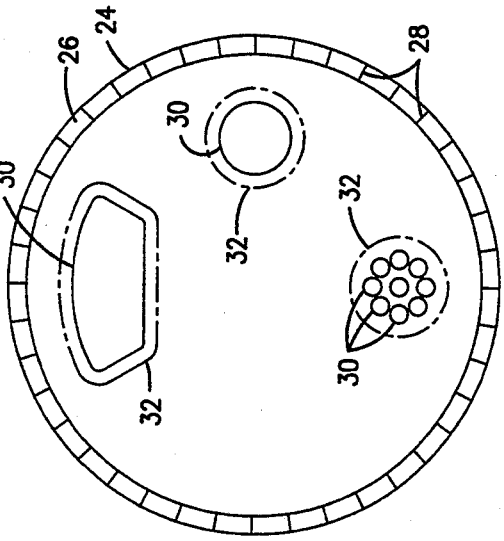
FIG. 3 is a top view of the container of FIG. 1 with the selector cap removed.

As is best shown in FIGS. 1, 3, and 4, this arrangement will result in the outer peripheral portion 26 of the disk forming a downwardly directed circular flange about the opening of the container body 12. Due to the sealing to the arcuate portion 22, or the somewhat resilient nature of the disk 14, the outer peripheral edge 24 of the disk will be spaced slightly outwardly from the side wall 18. Even where this is not the case, the bending of the peripheral portion 26 about the side wall 18 may result in numerous crimps in this portion 26, due to the larger peripheral length of the sealing disk compared to that of the side wall. As such, even where the majority of the peripheral portion 26 is in abutment against the side wall 18 (and possibly sealed thereto), these crimps may extend outwardly from the side wall to define the flange noted above. Regardless of which structural arrangement forms this flange, its presence is an important aspect of the present invention.

The sealing disk 14 also includes a plurality of openings 30 which extend through the disk. While a single opening 30 could be provided, it is preferred that multiple openings are provided at circumferentially spaced locations. For example, one of the openings 30 may be elongated in the circumferential direction such that a standard teaspoon may be inserted therethrough. Another of the openings 30 may be circular in shape and have an area less than that of the elongated opening. Yet another opening 30 may have a much smaller diameter and be one of a plurality of such openings arranged within a small area to define a shaker, as for use with salt. The sealing disk 14 is preferably of a sufficiently rugged nature that the openings 30 will maintain their shape and integrity through the anticipated life of the container 10.

The openings 30 may be maintained in their open position but are preferably provided with removable covers 32. The covers 32 are preferably formed of a paper or plastic having a pressure sensitive adhesive on a lower face thereof. This pressure sensitive adhesive may thus engage with the upper face of the sealing disk 14 to seal the openings against egress of the contents of the container. The sealing disk upper face may include an appropriate release coating or be formed of a material which readily releases from the adhesive.

A single cover 32 may be provided which extends over the upper face of sealing disk 14 within the opening to the container. However, to reduce the amount of material required, it is preferred that a plurality of covers 32 each having a peripheral configuration corresponding to, but larger than, an associated opening 30 are arranged over the associated openings 30.

To reduce contact of the contents of the container with the adhesive used to maintain the covers in position, the covers may be provided with adhesive free portions which are aligned with the openings 30. Alternatively, the adhesive employed may be of a suitable food grade which will not harm the contents by contact, and be formed as a uniform coating.

Mounted in covering relation over the sealing disk 14 is the selector cap 16. The selector cap 16 includes a substantially planar central portion 34 having a substantially circular periphery. As will be apparent from the discussion below, it is preferred that the bottom face of central portion 34 be in close, if not abutting, relation to the upper face of sealing disk 14. Where the side wall 18 includes the arcuate portion 22, this abutting relation may require that: the selector cap 16 include a peripheral shoulder 36 defining a peripheral groove 38 which opens downwardly and is adapted to receive the arcuate portion 22. This will allow the central portion to be spaced downwardly to a position adjacent the disk, which may be spaced downwardly relative to the uppermost extent of the arcuate portion due to the seal.

Extending downwardly from the outer peripheral edge of the central portion 34 (or shoulder 36) is a skirt 40. The skirt 40 includes a first portion 42 extending downwardly from the central portion 34 (or shoulder 36). The lower edge of first portion 42 is spaced outwardly from the side wall 18, preferably about the entire periphery of the side wall, but at least at one or more circumferential positions. This spacing may be effected by directing the first portion downwardly and outwardly with respect to the side wall 18, or the outer periphery of the central portion 34 (or shoulder 36) may be slightly greater than that of side wall 18, such that the first portion 42 may extend vertically downward.

The spacing of the lower end of the first portion 42 from the side wall 18 is preferably roughly similar to the spacing of the outer periphery 24 or crimps of the disk 14 from the side wall. Connected in proximity to the lower edge of first portion 42 (at least at those portions which are spaced from the side wall 18) is a catch portion 44 which extends inwardly towards the side wall 18 and preferably somewhat downwardly towards the bottom of the container. As is readily apparent from FIG. 4, the catch portion 44 will extend underneath the outer peripheral edge 24 (or the outer peripheral edge at the crimps) of the disk 14 to retain the selector cap 16 in position against upward movement with respect to the container.

It is an important aspect of the present invention that the selector cap may, with a single molding operation, be complete completely formed. No additional operations, such as closing lids molded in the open position or attaching additional elements is required. This greatly reduces production costs.

Another important aspect of the invention is that the selector cap is applied to the container with a simple downward motion, with no circumferential alignment or ancillary securing steps being required. As the cap is lowered onto the container the peripheral edge of the sealing disk (or the crimps) will resiliently deform inwardly, allowing the catch portion to pass thereover. The at least somewhat resilient nature of the sealing disk will cause the edge portion to then return to its original position, and thus resist upward movement, and removal, of the cap. This is an extremely simple assembly process in comparison to typical packaging methods, and greatly reduces the costs associated with the container.

Yet another advantage is obtained by the use of the peripheral edge portion and catch portion to maintain the cap on the container. While gross upward movement of the cap is prevented by the outer periphery of the disk, rotational movement with respect to the side walls 18, about the longitudinal axis of the container, is not prevented. To aid in this movement it is preferred that the catch portion be spaced slightly from the peripheral edge of the sealing disk, however, no additional elements or steps are required other than those described above. This is another important aspect of the invention.

This relative rotation between the selector cap 16 and the container and sealing disk 14 allows the user to selectively position the selector cap such that the openings 30 in the disk 14 are in registration with a cap aperture 46 extending through the selector cap 16. To provide full use of the openings 30 in the disk 14, the cap aperture 46 is preferably of a size and shape corresponding to the largest of the apertures 30. As may be seen by comparison between FIGS. 2 and 3, the aperture 46 may correspond to the large opening adapted to allow passage of a teaspoon into and out of the container. This will allow the full use of the opening 30 which has a corresponding shape. Additionally, when the aperture 46 is brought into registration with other types of openings 30, such as the single large circular opening or the multiple small circular openings, each of these openings will be fully usable, as they are located within the periphery of aperture 46.

Figure 2:
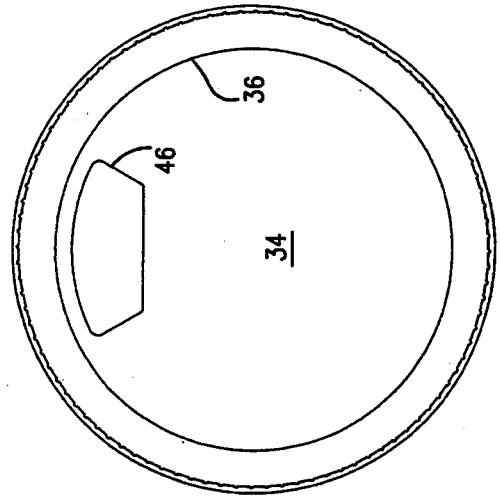
FIG. 2 is a top view of the container of FIG. 1.

As may also be seen by comparison with FIGS. 2 and 3, it is preferred that the openings and aperture be sized and arranged such that only one of the openings is in registration with the aperture at a time, and that the selector cap 16 may be rotated to a position where none of the openings are even partially registered with the aperture 46, such that the container is effectively closed from dispensing. In particular, it is preferred that the openings be arranged at 90° intervals with one of these intervals being without an opening, such that the user may rotate the selector cap between four positions, each corresponding to a different type of opening or a fully closed position. Where the selector cap 16 is in a closed position, the close proximity or abutment between the lower face of the central portion 34 of the selector cap and the upper face of the sealing disk 14 ensures that the openings 30 are adequately closed against dispensing.

To assist in the manual rotation of the selector cap with respect to the container body, the exterior periphery of first portion 42 of skirt 40 may be provided with ribs, knurling, or other friction enhancing configurations.

In use, the user would purchase the container with the selector cap 16 already engaged over the peripheral edge of the sealing disk. The user would then rotate the disk until the edges of the covers 32 are accessible through the aperture 46. The user will then remove the covers 32 to unseal the openings 30. The user may then place the selector cap in the desired rotational position for use or storage.

A modification may be made to the selector cap 16 to both provide increased security against inadvertent removal of the covers 32 from the openings 30, and to aid in the removal of the covers.

As shown in FIG. 1, the aperture 46 may be initially closed when the container is purchased by the consumer. In particular, a reduced thickness line 48 may be molded into the central portion 34 of the selector cap in a shape corresponding to that desired for the cap aperture 46. This reduced thickness line constitutes a weakened tear line defining a punch-out 50 within the confines of tear line 48, to be removed from the central portion 34 and thus form aperture 46. As may be readily seen, the presence of the punch-out 50 will eliminate access to the sealing disk 14 and covers 32, increasing their security.

To allow the user to easily remove the punch-out 50, and have access to remove the covers 32, it is necessary to allow the purchaser to remove the selector cap 16. To effect this, the selector cap 16 is provided with a means whereby the cap may be deformed such that the catch portion 44 is, at least along a section of its periphery, displaceable from beneath the outer peripheral edge of the sealing disk. Once the catch portion has been disengaged from the periphery of the sealing disk, the selector cap may be lifted free and punch-out 50 easily removed.

While various means may be provided for allowing the user to move the catch 44 from beneath the periphery 24, in a preferred embodiment the skirt 40 is provided with a release portion 52 extending downwardly and outwardly from the bottom end of catch portion 44, such that a lower end 54 of release portion 52 is spaced outwardly from the side wall 18. This outward spacing will allow the user to insert a finger or other object between the lower end 54 and side wall 18 such that pressure may be applied to release portion 52 to resiliently deform it away from side wall 18. As release portion 52 is connected to catch portion 44, this movement will also cause the catch portion 44 to be resiliently deformed away from the side wall and out of engagement with periphery 24 of the sealing disk. As shown in FIG. 4, the release portion 52 is formed as a dog leg, although other cross-sectional configurations are clearly possible. It is also noted that the release portion 52 is shown as extending about the entire periphery of the skirt 40, although it may be sufficient to provide the release portion 52 only at discreet circumferential locations.

While the present invention has been described with regard to a specific embodiment, it should be noted that various modifications may be made without departing from the scope of the invention. For example, the various shapes of the openings 30 and aperture 46 may, of course, be varied. Additionally, the release portion 52 may be a substantially planar member extending downwardly and outwardly from the bottom portion of catch portion 44. Alternatively, the release portion 52 may be located at a position above the catch portion 44 and extend outwardly from the first portion 42. All that is strictly required in this regard is that some mechanism be provided to allow the user to deform the catch portion out of engagement with the outer periphery of the sealing disk. It could also be possible to form the outer peripheral portion of the sealing disk as substantially rigid, with the selector cap skirt being more elastic.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A container for dispensing materials, comprising:

a container body including a bottom and a side wall extending upwardly from a periphery of said bottom to form a substantially circular upper edge;

a sealing disk having an outer peripheral portion formed of a resilient film, said sealing disk being secured to said upper edge such that said outer peripheral portion extends freely radially outward with respect to said upper edge a first distance to form an outer edge that is directed outwardly away from said side wall, said sealing disk including at least one opening therethrough; and an annular selector disk having a central portion in at least partial covering relation to said sealing disk, and a skirt having a first portion extending downwardly from said central portion and having a lower end spaced peripherally outward from said side wall, said skirt including a catch portion extending radially inward from said lower end of said first portion, both said first portion and said catch portion being radially spaced from said side wall by a distance less than said first distance to thereby cause resilient deformation of said outer portion of said sealing disk, said catch portion being located below, and radially inward of, said outer edge of said sealing disk, and said selector disk having means for forming an aperture, wherein abutment between said catch portion and said outer edge prevents gross upward movement of said selector disk with respect to said container body yet rotation of said selector disk with respect to said container body about a longitudinal axis of said container is allowed.

2. A container as in claim 1, wherein said outer edge is substantially circular.

3. A container as in claim 2, wherein said upper edge of said sidewall includes an arcuate portion, and said sealing disk is secured to said arcuate portion about said entire upper edge.

4. A container as in claim 1, wherein said means at least forming an aperture comprises a closed, reduced thickness line defining a punch-out, whereby removal of said punch-out by severing said reduced thickness line will form an aperture through said cap, said aperture being capable of alignment with said opening by said rotation of said cap.

5. A container as in claim 4, further comprising a label removably secured to said sealing disk in covering relation to said opening.

6. A container as in claim 1, wherein said at least one opening comprises a plurality of openings, each said opening being circumferentially spaced.

7. A container as in claim 6, further comprising at least one label removably secured in covering relation to said openings.

8. A container as in claim 1, wherein said skirt further comprises a release portion spaced peripherally outward from said side wall and adapted to be manually grasped for the application of pressure, and wherein at least said skirt is formed of a resilient material whereby such application of pressure will elastically deform said skirt to allow at least a portion of said catch portion to be moved to a position peripherally outward of said outer periphery.

9. A container as in claim 8, wherein said release portion is connected to said catch portion.

10. A method of packaging material, comprising the steps of:

providing a container body including a bottom and a side wall extending upwardly from a periphery of said bottom to form a substantially circular upper edge;

placing material within said container body;

providing a sealing disk having an outer peripheral portion formed of a resilient film, said sealing disk including at least one opening therethrough;

securing said sealing disk to said upper edge such that said outer peripheral portion extends freely radially outward with respect to said upper edge to form an outer edge that is directed radially outward from said side wall by a first distance;

providing an annular selector disk having a central portion and a skirt having a first portion extending downwardly from said central portion, said skirt including a catch portion extending radially inward from a lower end of said first portion, both said first portion and said catch portion being spaced radially outward from said side wall by a distance less than said first distance, said selector disk having means for forming an aperture, placing said selector disk on said container body with said central portion in at least partial covering relation to said sealing disk and with said catch portion being located below said outer edge and at least a portion of said resilient film outer portion extending into abutting communication with said first portion, wherein abutment between said catch portion and said outer edge prevents gross upward movement of said selector disk with respect to said container body, yet rotation of said selector disk with respect to said container body about a longitudinal axis of said container is allowed.

11. A method as in claim 10, wherein said step of placing said cap on said body comprises placing said cap and said body in spaced, substantially coaxial positions, with said skirt extending towards said upper edge of said body, and moving said cap and said body together, whereby said catch portion will pass over said outer periphery, the resilient nature of the peripheral edge causing said placement of said catch portion below and inward of said outer periphery.

12. A container for dispensing materials, comprising:

a container body including a bottom and a side wall extending upwardly from a periphery of said bottom to form a substantially circular upper edge;

a sealing disk having an resilient film outer peripheral portion, said sealing disk being secured to said upper edge such that at least portions of said outer peripheral portion extend freely outward with respect to said upper edge a first distance to form an outer edge; and an annular selector disk having a central portion in at least partial covering relation to said sealing disk, and a skirt having a first portion extending downward from said central portion and having a lower end spaced radially outward from said side wall, said skirt including a catch portion extending radially inward from said lower end of said first portion, said catch portion being radially spaced from said sidewall by a distance less than said first distance, said catch portion being located below, and inward of, said outer edge of said sealing disk, said selector disk having means for forming an aperture, said inward location of said catch portion with respect to said outer edge, maintained by said resilient outward bias of said outer periphery, prevents gross upward movement of said selector disk with respect to said container body and allows rotation of said selector disk with respect to said container body about a longitudinal axis of said container.

* * * * *